US006318547B1

(12) United States Patent
Pianezzola

(10) Patent No.: US 6,318,547 B1
(45) Date of Patent: Nov. 20, 2001

(54) POCKET-SIZE CONTAINER FOR METAL COINS

(76) Inventor: Pierino Pianezzola, Contrada Cengiati di Valdagno, 37, 36078 Valdagano, Vicenza (IT)

( * ) Notice: Subject to any disclaimer, the term of this patent is extended or adjusted under 35 U.S.C. 154(b) by 0 days.

(21) Appl. No.: 09/688,472

(22) Filed: Oct. 16, 2000

(30) Foreign Application Priority Data

Nov. 5, 1999 (IT) ..... VI99A0221

(51) Int. Cl.[7] ..... A45C 1/00
(52) U.S. Cl. ..... 206/0.81; 206/0.84; 206/38
(58) Field of Search ..... 206/0.8, 0.81–0.84, 206/37, 38, 234, 459.5, 564; 235/1 R, 499, 900

(56) References Cited

U.S. PATENT DOCUMENTS

| | | | | |
|---|---|---|---|---|
| 2,139,150 | * | 12/1938 | Curtis et al. | 206/0.84 |
| 2,985,284 | * | 5/1961 | Levy | 206/0.83 |
| 3,047,144 | * | 7/1962 | Wissel | 206/0.83 |
| 4,776,797 | * | 10/1988 | Hernandez | 206/0.84 |
| 4,781,290 | * | 11/1988 | Oliphant | 206/0.83 |
| 6,121,544 | * | 9/2000 | Petsinger | 206/37 |
| 6,202,835 | * | 3/2001 | Morse | 206/0.84 |

* cited by examiner

*Primary Examiner*—Luan K. Bui
(74) *Attorney, Agent, or Firm*—Bucknam and Archer

(57) ABSTRACT

A pocket-size container for metal coins has a structure in the form and dimensions of a normal credit card, debit card and similar documents and has a plurality of recesses (2). A coin is inserted into each of the recesses according to measure.

8 Claims, 2 Drawing Sheets

POCKET-SIZE CONTAINER FOR METAL COINS

FIELD OF THE INVENTION

This invention relates to a pocket-size container for metal coins.

BACKGROUND OF THE PRIOR ART

It is known that it is not always easy to keep and carry metal coins particularly if there are a large number of them. In fact because money of a high value is always in the form of a bank note, there is always the tendency to use wallets which provide for a suitable seat for the bank notes, as well as other further seats for credit cards and similar documents.

In the greater number of cases there is also provided a seat for the coins, which in general may be closed by means of a snap button but this seat necessarily offers dimensions which are somewhat reduced. In this manner the quantity of coins which may be lodged in the seat is necessarily limited. In addition, even if one inserts a limited number of coins this seat inevitably has a tendency to enlarge itself, a fact which causes problems both for closing the wallet and also for closing the same seat by means of the button. In fact, there are still used coinholders which consist of objects in the form of a small pocket or a small bag, in which the coins are placed. However their use at present is rather reduced also because the user should bring both the wallet and the coinholder, with obvious problems of space and practicality of use. Naturally it is possible to lodge the coins simply disorderly and with confusion in a pocket, in a bag or similar articles but this result is not practical because in this manner it is very difficult to remove the coins at the time when the coins should effectively be used.

SUMMARY OF THE INVENTION

The object of the present invention is to provide a device which allows orderly lodging of a certain number of metal coins while avoiding the drawbacks described hereinabove.

This object is achieved according to the invention by providing a structure which has the shape and dimensions of the normal credit card, debit card or similar documents, with a plurality of recesses, the structure allowing the insertion in each of the recesses of a coin according to measure. In each of the recesses there are provided means for keeping the coins in the recesses, unless a specific effort is made for the extraction from the recess by applying a pressure on the face of the first coin inserted in the recess.

In fact the user has the inclination for an object which has the shape of a card, the object being lodged with no difficulty in a pocket or in the seat of credit card documents which are normally provided in the wallet.

In the dependent claims there are described particular forms of achievement of the invention capable of making it particularly useful and effective for the user.

BRIEF DESCRIPTION OF THE DRAWINGS

These and other characteristics of the invention will be described in detail hereinbelow by reference to particular forms of achievement provided by way of non-limiting examples by reference to the figures, in which.

DETAILED DESCRIPTION

Figure 1:
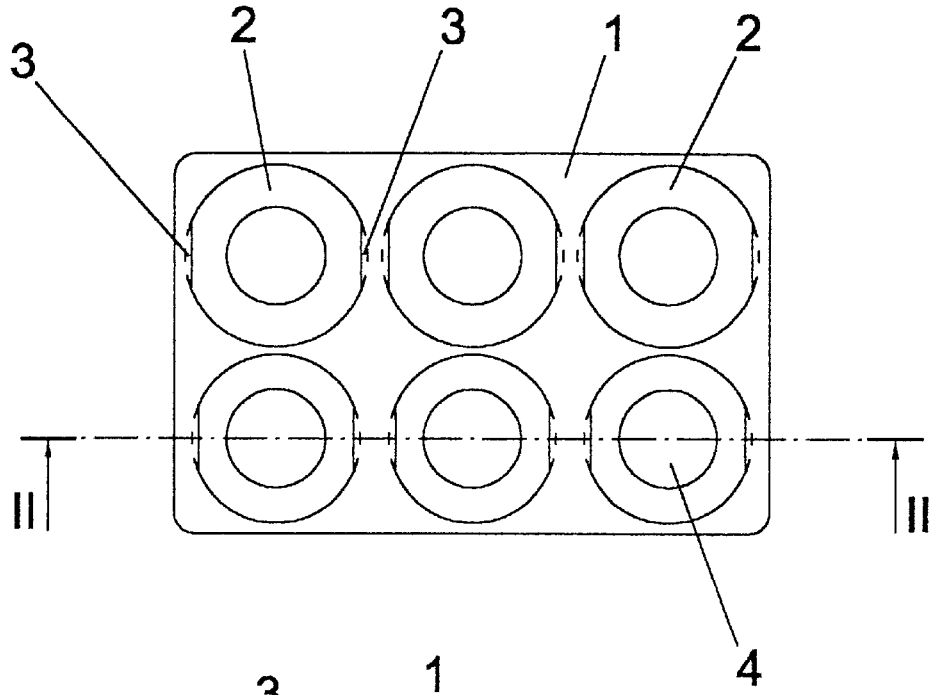
FIG. 1 is a plan view of a particular form of achievement of the device of this invention.
Figure 2:
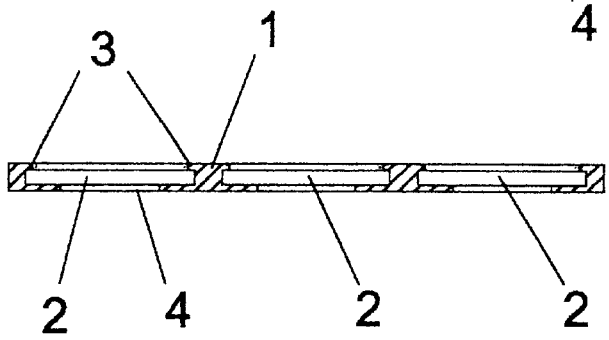
FIG. 2 is a cross sectional view of the device of FIG. 1 taken along line II—II.
Figure 3:
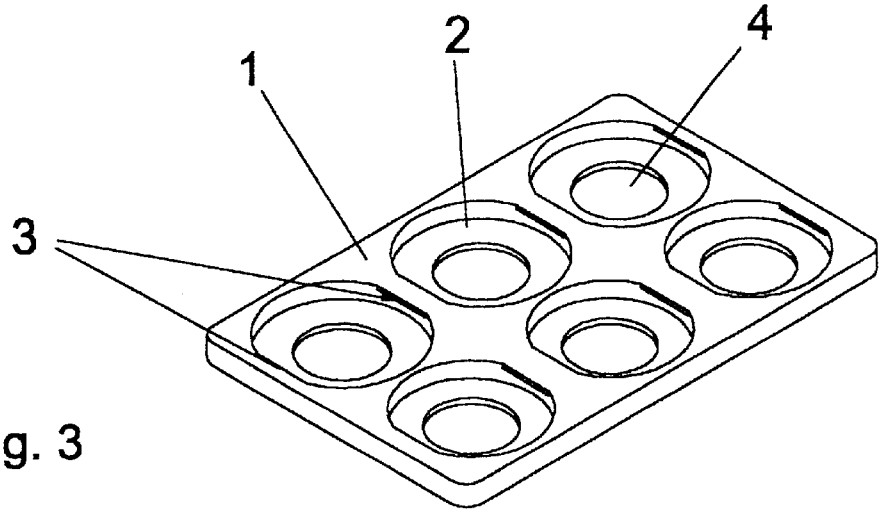
FIG. 3 is a perspective view of the same.

FIG. 1 shows that the device of the present invention consists of a structure (1) which has the form and dimensions corresponding to the usual credit card, debit card or similar documents. In this structure there is formed a plurality of recesses (2), which in this case have a circular shape. In each recess there is inserted a coin, according to measure. Naturally these recesses could also have diameters different one from the other, for the purpose of allowing lodging of coins of different type and value.

Each recess is provided with means suitable to allow the keeping of the coin in the recess. In this particular form of achievement these means are constituted by at least two small indentations (3) which are preferably in position diametrically opposite corresponding to the opening of recess (2).

In practice the coin may be inserted in the recess by taking advantage of the elasticity of the material of which the container is made, slightly deforming the indentations. After the deformations are overcome the coin has a tendency to remain in recess (2) in a stable manner.

In order to allow the extraction of the coin from the recess, when the coin must be used, there is provided an opening (4) corresponding to the part of the container opposite to the part in which is made the opening for the introduction of the coin in recess (2). In actual practice the user applying pressure on the face of the first coin which has been inserted in the recess, by taking advantage of opening (4), is in position to cause the coin to be removed from the recess.

In fact, the presence of opening (4) may be eliminated and the pressure on the coin to cause the coin to be removed may be carried out by taking advantage of the elasticity of the wall of the container opposite to the wall involved in the insertion of the coin in the recess.

For the purpose of allowing the coin to remain in the recess, there is provided an alternative to the solution already described. The alternative consisting of an undercut corresponding to the mouth of the recess.

It is possible to indicate on the container the value of each coin lodgeable in the container or also the total value of the lodged coins. These values may eventually be indicated in the characters of the Braille alphabet so as to allow use by people who do not see. Finally it is possible to provide a plurality of containers according to the invention to be grouped with other similar containers in the interior of a suitable holder to form a true purse.

Figure 4:
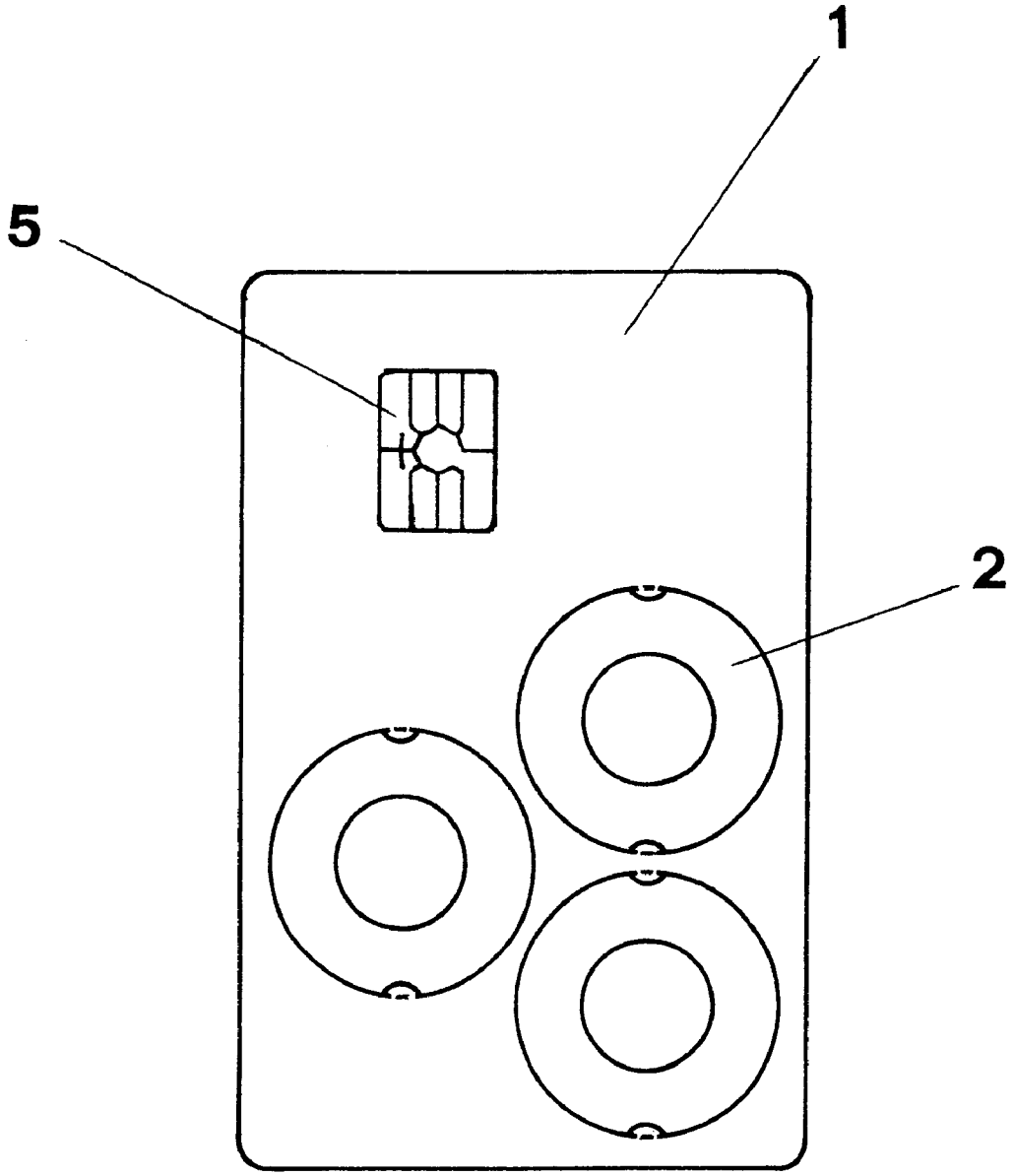
FIG. 4 is a plan view of a further form of achievement of the device of this invention.

FIG. 4 shows that by disposing and configuring recesses (2) in a manner that a certain space remains free of the recesses on the surface of structure (1), it is possible to dispose in this free zone a memory element (5) (microchip) in a manner analogous to what is carried in telephone cards, electronic keys for parking spaces, hotel rooms and similar items. In this manner the user has the disposal to obtain in the same card, a memory element and a container for coins.

In addition it is possible to provide in the spaces free of the recesses of structure (1) the presence of written items, figures, trademarks and similar material.

On the basis of the foregoing it is clear that by means of the device of this invention it is possible to avoid the drawbacks described hereinabove. Further the device of this invention is simple, economical and particularly usable in a practical manner.

What is claimed is:

1. A pocket-size container for metal coins which provides structure (1) which has the form and dimensions of a credit card or a debit card and a plurality of recesses (2) in said structure (1), at least one coin being inserted in each of said recesses according to measure, said container having a first part in which is made the opening for the introduction of said at least one coin and a second part opposite thereto, means capable of holding the coin in the recess, extracting said coin from the recess by applying a pressure on said second part of said container, said container has a surface and wherein a part of said surface is free of the recesses, and in the area which is free of the recesses a memory element which includes a microchip of the type normally used in telephone cards, electronic keys for parking places, hotel rooms and similar articles is present.

2. The container according to claim 1 wherein said means for holding said at least one coin in the recess are constituted by at least two indentations (3), disposed in position diametrically counterposed, along the border of the opening through which the coin is inserted in the recess.

3. The container according to claim 1 wherein said recess has a lateral border and the means for holding the coin in the recess are constituted by an undercut applied along the lateral borders of recess (2).

4. The container according to claim 1 wherein corresponding to each of the recesses on the wall opposite to the wall corresponding to which the coin is inserted in the recess, opening (4) is present, said opening being capable of allowing the extraction of the coin from the recess.

5. The container according to claim 1 wherein on the surface of said recess are shown at least the value of the coins inserted in the recess or said value and total value of the inserted coins.

6. The container according to claim 5 wherein said values are expressed in the Braille alphabet.

7. A group of containers according to claim 1 wherein said containers are grouped within a suitable holder.

8. A container according to claim 1 wherein in the areas of said structure (1) which is free of recesses, written material, figures, trademarks are present.

* * * * *